US007695087B2

(12) United States Patent
Tsuboi

(10) Patent No.: US 7,695,087 B2
(45) Date of Patent: Apr. 13, 2010

(54) PRINTING APPARATUS AND PRINTING METHOD

(75) Inventor: Hitoshi Tsuboi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 11/563,949

(22) Filed: Nov. 28, 2006

(65) Prior Publication Data

US 2007/0120883 A1 May 31, 2007

(30) Foreign Application Priority Data

Nov. 30, 2005 (JP) ..... 2005-346972

(51) Int. Cl.
*B41J 29/38* (2006.01)

(52) U.S. Cl. ..... 347/14; 347/5; 347/42

(58) Field of Classification Search ..... 347/5, 347/9, 42, 12, 14, 19
See application file for complete search history.

(56) References Cited

U.S. PATENT DOCUMENTS 5,610,634 A * 3/1997 Murata et al. ..... 347/5
6,464,332 B1 * 10/2002 Silverbrook et al. ..... 347/42
2008/0049057 A1 2/2008 Ochiai et al.

FOREIGN PATENT DOCUMENTS

JP 2004-268326 9/2004
JP 2004-268394 9/2004

* cited by examiner

*Primary Examiner*—Lam S Nguyen
(74) *Attorney, Agent, or Firm*—Fitzpatrick, Cella, Harper & Scinto

(57) ABSTRACT

A printer and printing method can print at high quality at a printing boundary where different printing elements can print in the same area of a printing medium. When printing by moving a printhead, in which a plurality of printing elements are arrayed, relatively to a printing medium, the following control is performed. That is, it is checked whether different printing elements are printable in the same area on the printing medium on the basis of input image data. It is checked whether the input image data is used to print a text image or a graphic/halftone image. It is controlled in accordance with the check results to print in the same printable area by the different printing elements by changing respective ratios at which printing elements are used.

5 Claims, 8 Drawing Sheets

PRINTING APPARATUS AND PRINTING METHOD

BACKGROUND OF THE INVENTION

1. Field of the Invention

The present invention relates to a printing apparatus and printing method. Particularly, the present invention relates to, for example, an inkjet printing apparatus using a full-line printhead having a printing width equal to the width of a printing medium, and a printing method.

2. Description of the Related Art

There has conventionally been known an inkjet printing apparatus (to be referred to as a printing apparatus hereinafter) which prints an image on a printing medium using an inkjet printhead (to be referred to as a printhead hereinafter) having a plurality of ink discharge nozzles (to be referred to as nozzles hereinafter) arrayed as a plurality of printing element arrays.

There has been proposed a printing method of repeating an operation to print while moving the printhead relative to the printing medium in a direction (main scanning direction) perpendicular to the discharge nozzle array, and then moving the printing medium in the nozzle array direction (subscanning direction) by approximately 1/n (n is an integer of 2 or more) of the nozzle array length. This method is called multipass printing, and is popular because it can achieve high-quality printing at low cost by printing in an area corresponding to the nozzle array width of the printhead in n print scanning operations.

However, higher-speed printing is possible if the number of operations (to be referred to as printing passes hereinafter) to print while moving the printhead relative to the printing medium in the main scanning direction is reduced. For this purpose, it is desirable to print over the area of the nozzle array width in one scan, increase the length by which the printing medium moves in the subscanning direction, and print on the entire printing medium in a smaller number of printing passes.

In this case, image quality readily degrades at the boundary between printing passes due to density unevenness caused by the printing time difference and printing position imprecision, blur at the printed image edge, and the like.

Besides serial printing apparatuses which print while moving the printhead in the main scanning direction, others also exist which print using a full-line printhead in which a plurality of head chips, each having a printing element array of printing elements, are arranged in the printing element array direction. The printing width of the full-line printhead corresponds to the width of the printing medium, and a printing apparatus of this type can print by only conveying the printing medium perpendicularly to the printing element array direction. Even in this printing apparatus, however, image quality degrades at the boundary between head chips due to density unevenness caused by the printing time difference and printing position imprecision, blur at the printed image edge, and the like.

To prevent a degradation in quality, there has been proposed a method (to be referred to as "gapless connection" hereinafter) of printing without any gap between the printing passes of a serial printing apparatus or between the head chips of a full-line printing apparatus. There has also been proposed a method of distributing printing to two adjacent printing passes or head chips so as to create an overlap between printing passes or head chips and make the boundary between printing passes or head chips less conspicuous. The distribution method includes several methods such as distributed printing by a gradation mask.

The gapless connection printing method prints using either one of adjacent printing passes or head chips, so the edge of a printed image looks sharp at the boundary but density unevenness and the like readily stand out.

On the other hand, with the printing distribution method, the density difference between printing passes or head chips gradually changes within the overlapping area and is less noticeable, and the printing position shift and density unevenness at the overlapping area can be readily reduced.

In either printing method, the boundary is still a factor in quality degradation, and it is desirable to avoid connection processing as much as possible. For this purpose, there have been proposed various printing methods. For example, according to Japanese Patent Publication Laid-Open Nos. 2004-268326 and 2004-268394, an overlap is formed between the head chips of a full-line printing apparatus, and only one of the head chips prints a cluster of drawing objects (e.g., text, character string, graphics, or bitmap) which are printable by only one head chip. More specifically, Japanese Patent Publication Laid-Open No. 2004-268326 proposes a method of distribution to a plurality of head chips. According to this method, when head chips overlap each other, a drawing object printable by one head chip is determined to cause the head chip to print. Japanese Patent Publication Laid-Open No. 2004-268394 discloses correction means for correcting printing so that no unprinted portion occurs at the overlap between drawing objects when distributing printing to one head chip.

However, the following problem arises with these conventional methods of forming an overlap between the printing passes of a serial printing apparatus or between the head chips of a full-line printing apparatus and distributing printing to two adjacent printing passes or head chips. More specifically, the conventional methods can easily reduce the printing position shift and density unevenness at the overlap. However, in a case where edge sharpness is considered as a more important factor than density unevenness, like a text image, the edge blurs and the image quality degrades, compared to gapless connection due to a small printing position shift between a plurality of printing passes or head chips.

The processing target of the methods disclosed in Japanese Patent Publication Laid-Open Nos. 2004-268326 and 2004-268394 is limited to only a cluster of drawing objects (e.g., a text, character string, graphics, or bitmap) printable by only one head chip. The size of the processing target is small unless the overlap between head chips is sufficiently large, compared to the drawing object size. Thus, these methods are not applicable to most of drawing objects, and a plurality of head chips must print. This processing is complicated, prolongs the printing time, and decreases reliability because the position and size of a drawing object must be determined.

It is desirable to be able to print a high-quality image at the boundary in both a text image for which edge sharpness is important and a bitmap image for which suppression of density unevenness is important, regardless of whether or not either one of adjacent printing passes or adjacent head chips can print a drawing object.

SUMMARY OF THE INVENTION

Accordingly, the present invention is conceived as a response to the above-described disadvantages of the conventional art.

For example, a printing apparatus and printing method according to this invention are capable of printing at high quality even at a printing boundary where different printing elements can print in the same area of a printing medium.

According to one aspect of the present invention preferably, there is provided a printing apparatus which uses printing means in which a plurality of printheads each having an array of printing elements are arranged along an array direction of the printing elements such that part of the arrayed printing elements in one of the plurality of printheads overlap part of the arrayed printing elements in another one of the plurality of printheads in the array direction, and which prints by moving the printing means relatively to a printing medium, comprising: first determination means for determining whether different printheads are printable in the same area on the printing medium on the basis of input image data; second determination means for determining whether the input image data is used to print a text image or a graphic/halftone image; and control means for controlling to print in the same printing area printable by the different printheads by changing respective ratios at which printing elements of the different printheads are used, in accordance with determination results by the first determination means and the second determination means.

The apparatus preferably further comprises conveyance means for conveying the printing medium.

The apparatus is basically applied to two types of printing apparatuses.

One is a printing apparatus having a full-line printhead, and the other is a serial printing apparatus which scans the printhead.

A specific arrangement suitable for the former apparatus is as follows.

That is, each of the plurality of printheads includes a head substrate which is built by arraying a plurality of printing elements and has a first printing width. The plurality of printheads constitutes a full-line printhead, whose printing width is longer than the first printing width, and printing elements at ends of respective head substrates overlap each other at a coupling portion between adjacent head substrates.

In this case, the first determination means preferably determines whether or not printing based on the input image data is performed using printing elements overlapping at a coupling portion.

In a case where the second determination means determines that the input image data is used to print a text image, the control means preferably controls to print at the coupling portion by driving a printing element of either one of two head substrates forming the coupling portion. More specifically, the control means desirably controls to switch a printing element used for printing from, out of printing elements overlapping at the coupling portion, a printing element of one head substrate of the two head substrates forming the coupling portion to a printing element of the other head substrate.

In a case where the second determination means determines that the input image data is used to print a graphic/halftone image, the control means preferably controls to print at the coupling portion by using printing elements of two head substrates forming the coupling portion. More specifically, the control means desirably controls to switch a printing element used for printing by changing a ratio at which printing is performed using printing elements of one head substrate of the two head substrates forming the coupling portion out of all printing elements at the coupling portion and a ratio at which printing is performed using printing elements of the other head substrate.

A specific arrangement suitable for the latter apparatus is as follows.

That is, the apparatus further comprises scanning means for scanning the printing means in a direction perpendicular to a conveyance direction of the printing medium by the conveyance means, and a printing area by scan printing of the printing means overlaps a printing area by the next scan printing.

In this case, the first determination means preferably determines whether or not printing based on the input image data is performed in the overlapping printing area.

In a case where the second determination means determines that the input image data is used to print a text image, the control means preferably controls to print in the overlapping printing area by either one of two scan printing operations of forming the overlapping printing area.

In a case where the second determination means determines that the input image data is used to print a graphic/halftone image, the control means preferably controls to print in the overlapping printing area by two scan printing operations of forming the overlapping printing area.

According to another aspect of the present invention, preferably, there is provided a printing method of a printing apparatus which uses printing means in which a plurality of printheads each having an array of printing elements are arranged along an array direction of the printing elements such that part of the arrayed printing elements in one of the plurality of printheads overlap part of the arrayed printing elements in another one of the plurality of printheads in the array direction, and which prints by moving the printing means relatively to a printing medium, comprising: a first determination step of determining whether or not different printheads are printable in the same area on the printing medium on the basis of input image data; a second determination step of determining whether the input image data is used to print a text image or a graphic/halftone image; and a control step of controlling to print in the same printing area printable by the different printheads by changing respective ratios at which printing elements of the different printheads are used, in accordance with determination results in the first determination step and the second determination step.

The invention is particularly advantageous since high-quality printing is possible even at a printing boundary where different printing elements can print in the same area of a printing medium.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

Figure 1:
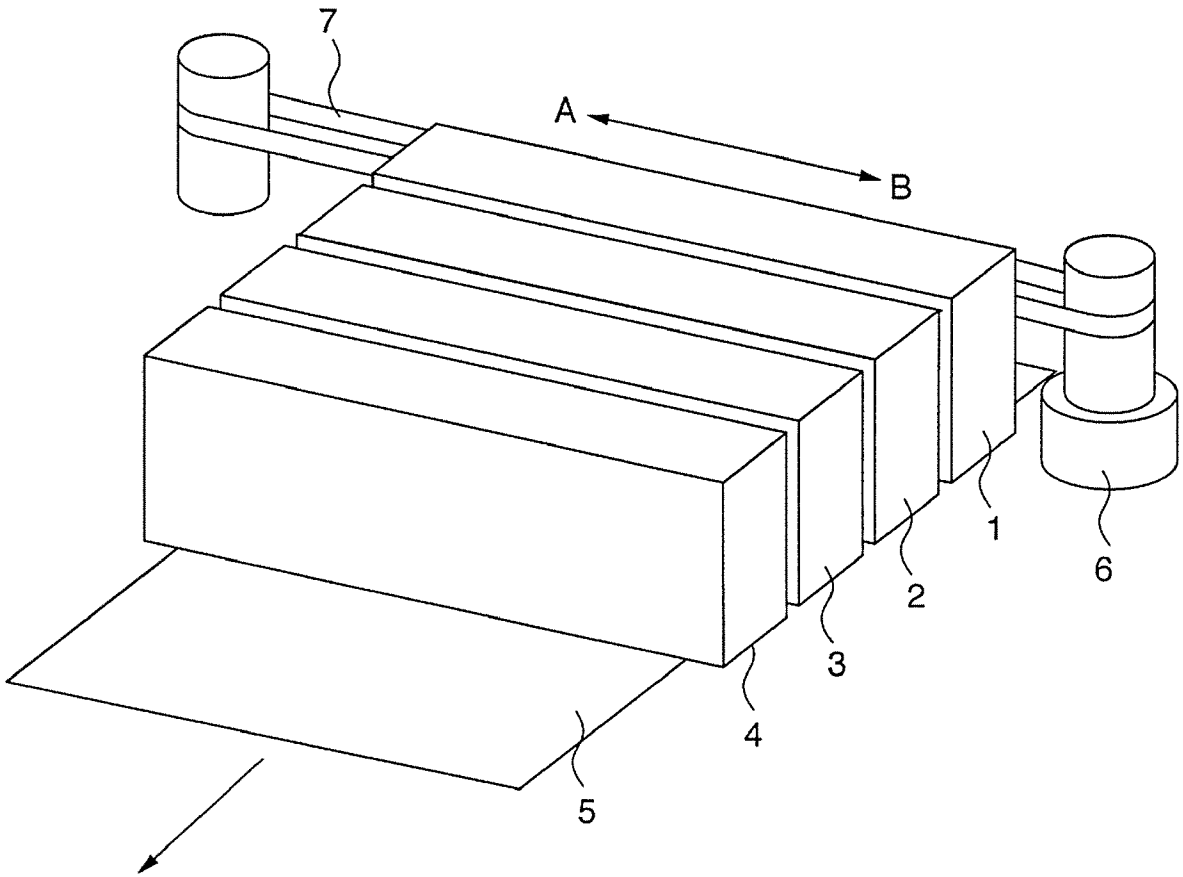
FIG. 1 is a schematic view showing the arrangement of an inkjet printing apparatus as a typical embodiment of the present invention.

FIG. 1 is an outer perspective view showing the schematic arrangement of an inkjet printing apparatus (to be referred to as a printing apparatus hereinafter) as a typical embodiment of the present invention.

As shown in FIG. 1, the printing apparatus comprises four full-line printheads (to be referred to as printheads hereinafter) 1 to 4 each having a printing width corresponding to that of a printing medium 5. These printheads each have an array of ink discharge nozzles (to be referred to as nozzles hereinafter) for discharging ink. The printheads 1 to 4 respectively discharge inks of black (K), cyan (C), magenta (M), and yellow (Y) These printheads are connected to ink supply tubes (not shown) for supplying inks from ink tanks (not shown), and receive control signals, printing signals, and the like from a control circuit via a flexible cable (not shown).

Examples of the printing medium 5 are plain paper, high-quality dedicated paper, an OHP sheet, glossy paper, a glossy film, and a postcard. The printing medium 5 is clamped between conveyance rollers (not shown), discharge rollers (not shown), or the like, and conveyed in a direction (conveyance direction) indicated by an arrow in accordance with driving of a conveyance motor (not shown). The nozzles (fluid channels) of the printheads 1 to 4 incorporate printing elements (electrothermal transducers or heaters) which generate thermal energy used for discharging ink. In printing, the printing medium 5 is conveyed in the direction indicated by the arrow. Along the conveyance direction, a linear encoder (not shown) is arranged to detect the position of the printing medium. The printing elements are driven on the basis of a printing signal at the read timing of the printing medium position by the linear encoder. Ink droplets are discharged and attached onto the printing medium, thereby printing an image.

The printheads 1 to 4 constitute one unit as a whole, which is attached to a printhead moving belt 7. The printheads 1 to 4 can move in a direction indicated by an arrow A or B in FIG. 1 by driving a printhead position control motor 6 in accordance with the width of a print image or the size of a printing medium and moving the printhead moving belt 7. The printing elements or nozzles of the printheads 1 to 4 are arrayed in the direction indicated by the arrows A and B. This direction is called the main scanning direction and the printing medium conveyance direction is called the subscanning direction.

While printing stops, a capping mechanism (not shown) caps the ink orifice surfaces of the printheads 1 to 4 so as to prevent clogging caused by solidified ink due to evaporation of the ink solvent or attachment of a foreign matter such as dust.

To solve a discharge failure and clogging at a nozzle whose printing frequency is low, the capping function of the capping mechanism is exploited for non-printing discharge of discharging ink to a cap portion separated apart from the nozzle, or for recovery of a nozzle suffering a discharge failure by operating a pump (not shown) and sucking ink from the nozzle while capping the ink discharge surface of the printhead. Also, the ink discharge surface of the printhead can be cleaned by arranging a blade or wiping member (not shown) at a position adjacent to the cap portion.

Figure 2:
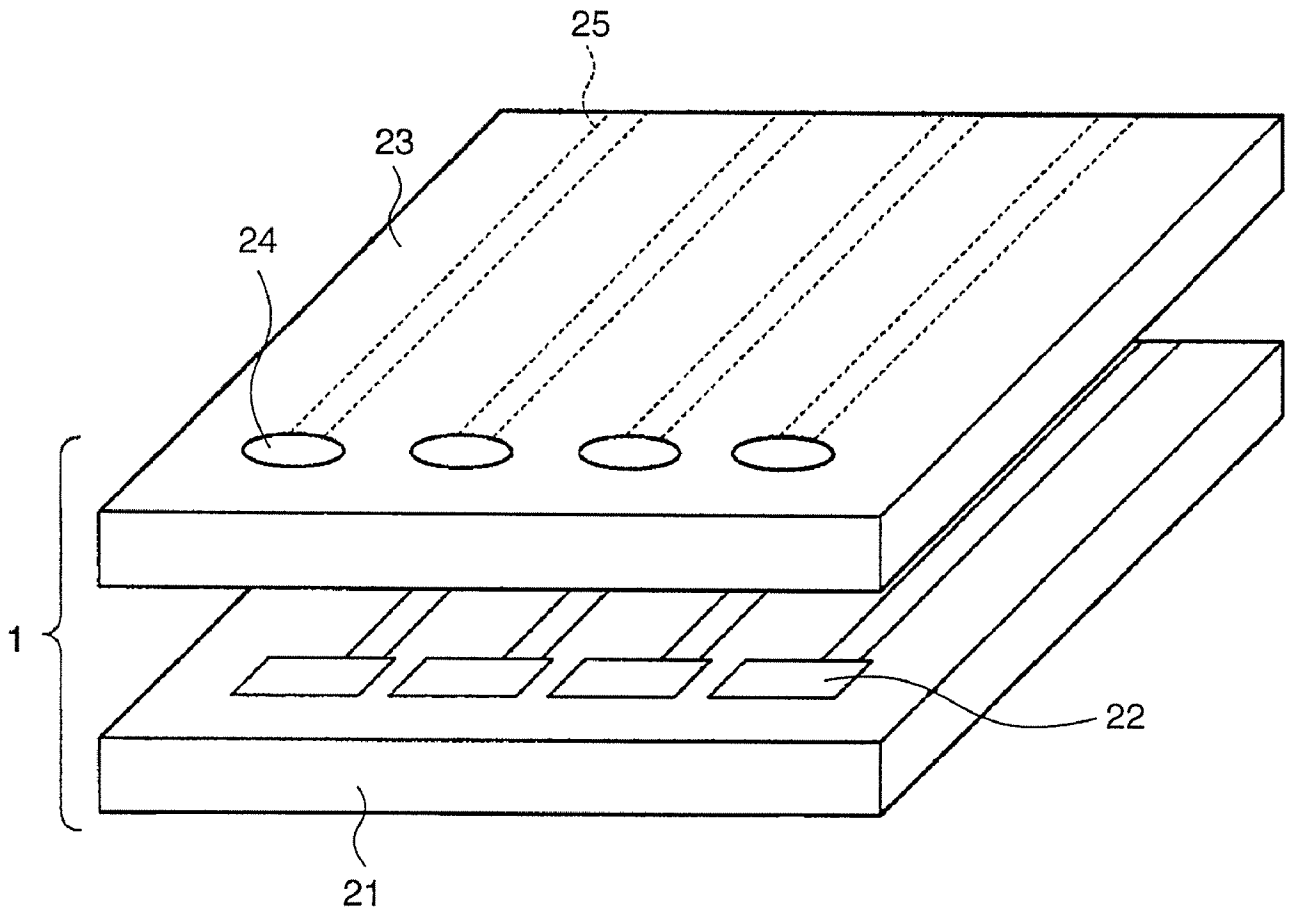
FIG. 2 is a view schematically showing the structure of part of a printhead used in the inkjet printing apparatus shown in FIG. 1.

FIG. 2 is a perspective view showing part of the printhead structure shown in FIG. 1. The printheads 1 to 4 basically have the same structure, and FIG. 2 exemplifies the printhead 1.

As shown in FIG. 2, the printhead 1 is configured by forming a plurality of heaters 22 for heating ink on a heater board 21 serving as a head substrate, and covering the heater board 21 with a top plate 23. The top plate 23 has a plurality of nozzles 24, and tunnel-like fluid channels 25 connecting with the nozzles 24 are formed on the rear side of the nozzles 24. The fluid channels 25 are commonly connected to one ink chamber (not shown) on the rear side. The ink chamber receives ink from an ink tank via an ink supply port, and supplies the ink to the respective fluid channels 25.

The heater board 21 and top plate 23 are aligned and assembled so that the heaters 22 are located at positions corresponding to the fluid channels 25.

FIG. 2 shows only four heaters 22, but the heaters 22 are arranged in one-to-one correspondence with the respective fluid channels 25. When supplying a predetermined driving pulse to the heater 22 while assembling the heater board 21 and top plate 23 as shown in FIG. 2, ink on the heater 22 boils and forms bubbles, and is squeezed and discharged from the nozzle 24 by volume expansion of the bubbles.

The inkjet printing method applicable to the present invention is not limited to a thermal printing apparatus using an electrothermal transducer (heater) as shown in FIGS. 1 and 2. For example, a continuous printing apparatus which continuously sprays ink droplets to form particles might adopt charge control, divergence control, and the like. An on-demand printing apparatus which discharges ink droplets, as needed, might employ pressure control to discharge ink droplets from orifices by mechanical vibrations of a piezoelectric vibrator.

Figure 3:
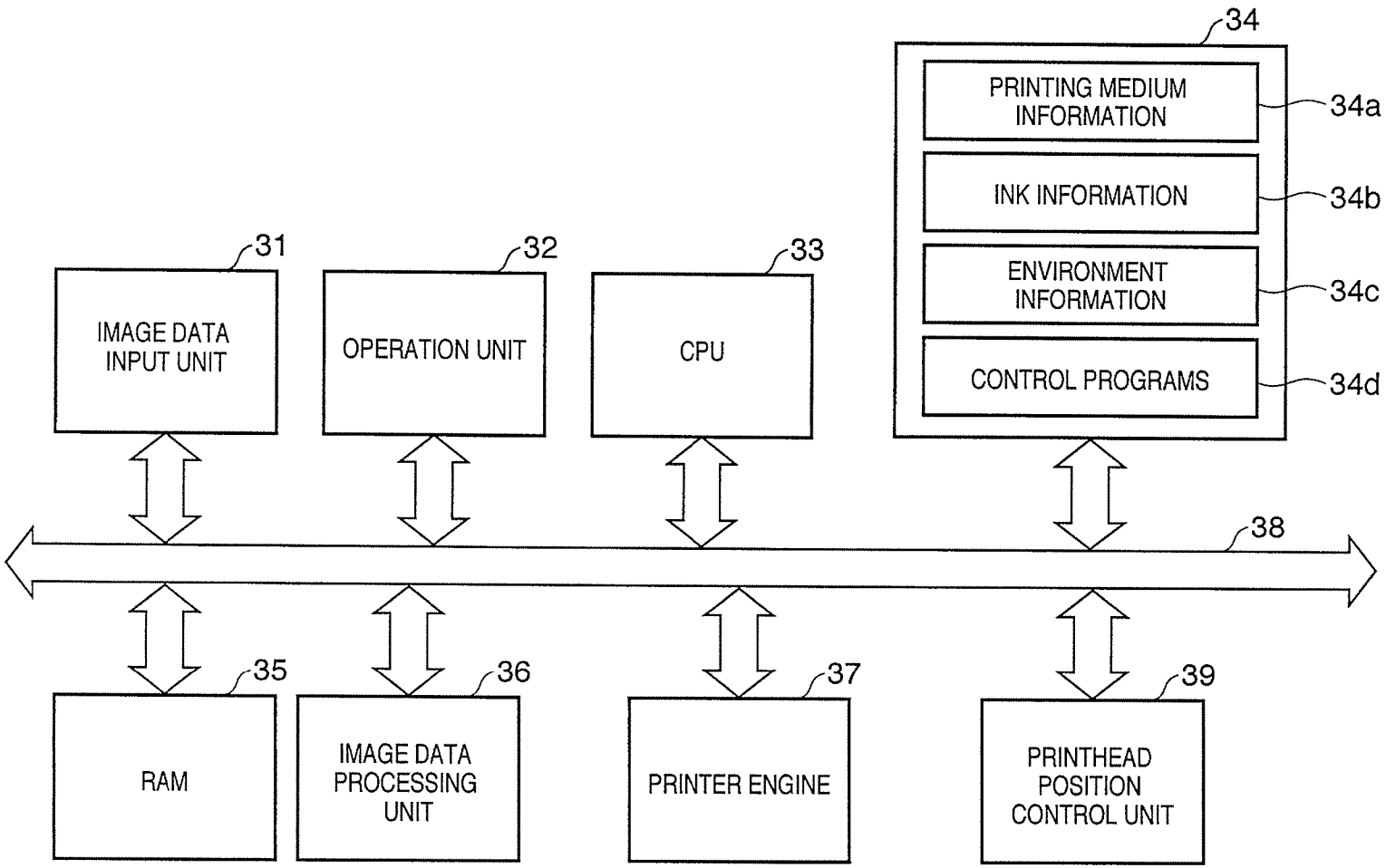
FIG. 3 is a block diagram showing the arrangement of the control circuit of the inkjet printing apparatus shown in FIG. 1.

FIG. 3 is a block diagram showing the control arrangement of the printing apparatus shown in FIG. 1.

In FIG. 3, reference numeral 31 denotes an image data input unit; 32, an operation unit; 33, a CPU which performs various processes accompanying printing control and controls the overall printing apparatus; and 34, a nonvolatile memory (e.g., ROM, EEPROM, or FeRAM) which stores various data. As other examples of the nonvolatile memory, especially a storage medium which stores a program, an FD, CD-ROM, HD, memory card, memory stick, and magneto-optical disk are also available.

The nonvolatile memory 34 includes a storage unit 34*a* which mainly stores information on the type of printing medium, a storage unit 34*b* which stores information on ink used for printing, a storage unit 34*c* which stores information on the environment such as the temperature and humidity in printing, and a storage unit 34*d* which stores various control programs used for printing control (to be described later). Reference numeral 35 denotes a RAM; 36, an image data processing unit; 37, a printer engine which outputs an image; 38, a bus which transfers an address signal, data, control signal, and the like between building components; and 39, a printhead position control unit which controls the relative positions of the printheads 1 to 4 and printing medium 5.

These building components will be described in detail. The image data input unit 31 receives multi-valued image data from an image input device such as a scanner or digital camera, and multi-valued image data saved in the hard disk of a personal computer or the like. The operation unit 32 comprises various keys which allow a user to designate the start of printing and set various parameters pertaining to a printing operation (e.g., the image printing width, the size of a printing medium, the type of printing medium, and the type of print image (photo, graphics, text, or the like)).

The RAM 35 functions as a work area used to execute various programs stored in the nonvolatile memory 34 by the CPU 33, a temporary save area in error processing, and a work area in image processing. The RAM 35 is also used when copying various tables stored in the nonvolatile memory 34, changing the contents of the tables, and advancing image processing in reference to the changed tables.

The image data processing unit 36 quantizes input multi-valued image data into N-ary image data for each pixel, and generates an ink discharge pattern corresponding to a tone value "K" represented by each quantized pixel. That is, the image data processing unit 36 performs N-ary processing for input multi-valued image data, and creates an ink discharge pattern corresponding to the tone value "K".

For example, according to the embodiment, when the image data input unit 31 receives multi-valued image data which expresses each component of one pixel by 8 bits (256 tone levels), the image data processing unit 36 converts the tone value of output image data into a 25(=24+1)-ary. The K-ary processing for input tone image data can adopt, e.g., a multi-valued error diffusion method, but may employ another method such as any desired halftoning processing method (e.g., average density conservation method or dither matrix method). By repeating this K-ary processing for all pixels on the basis of density information of the image, binary driving signals representing whether to discharge ink or not are formed for pixels corresponding to nozzles.

The printer engine 37 discharges ink on the basis of the discharge pattern generated by the image data processing unit 36, and forms a dot image on a printing medium.

In addition to the above arrangement, the printing apparatus comprises an interface (not shown) which receives image data, a printing instruction, and control information from an external device (e.g., host computer). The printing apparatus may also receive, from an external device through this interface, the same information as that input by the user from the operation unit 32.

Print data can be prepared in accordance with a method used in a general inkjet printing apparatus. In the embodiment, color image data of an input image is decomposed into four color components in accordance with the four printheads, and halftone image data of the color-decomposed components are binarized using an error diffusion method, preparing data to be printed by the printheads 1 to 4.

An actual printing operation executed by the printing apparatus having the above arrangement will be explained.

Figure 4:
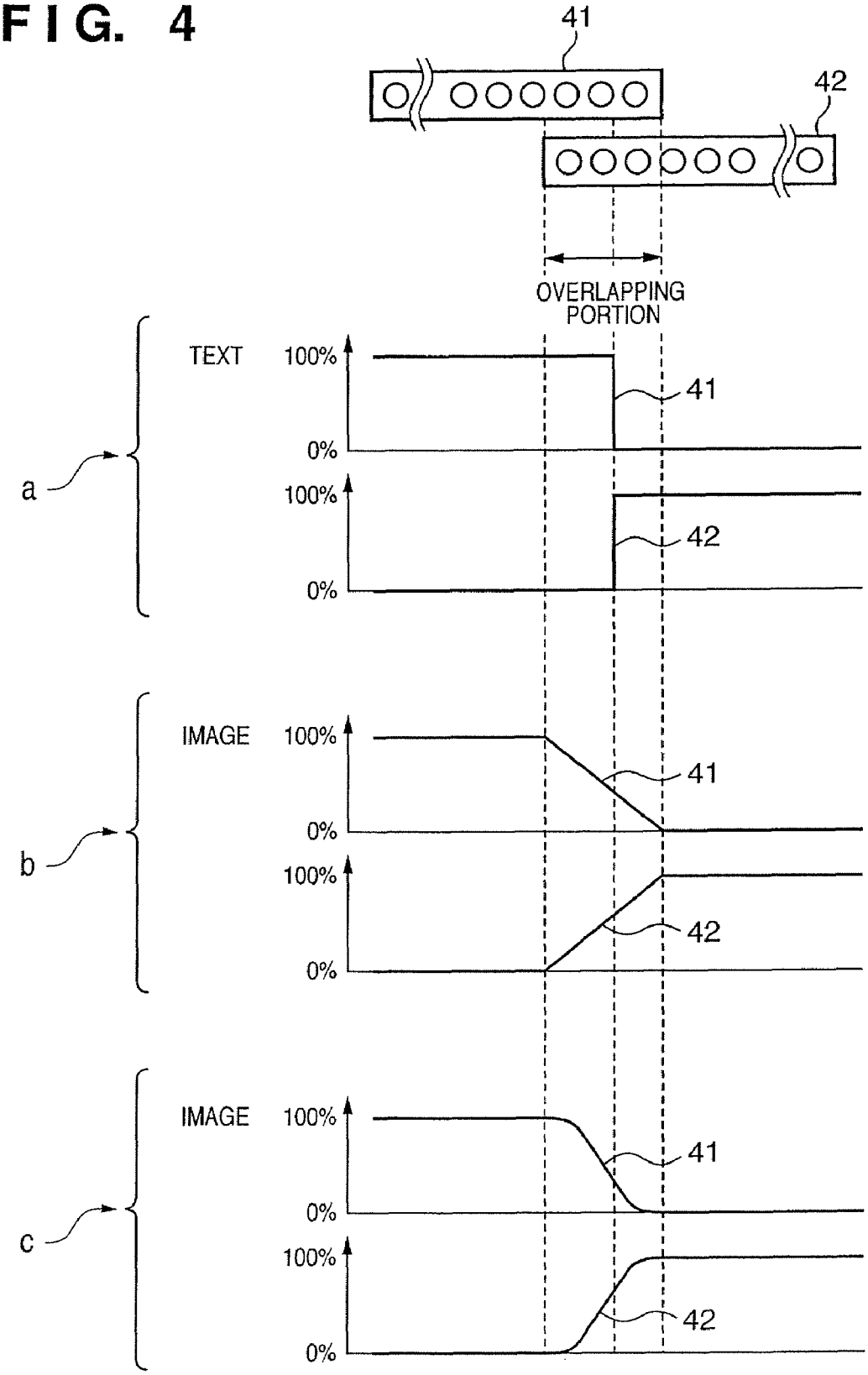
FIG. 4 is a schematic view showing the layout of a plurality of nozzles in a full-line printhead.

FIG. 4 is a schematic view showing the layout of a plurality of nozzles in the full-line printhead.

As shown in FIG. 4, the full-line printhead of the embodiment forms a nozzle group with a long printing width as a whole by laying out a plurality of head chips (in this case, a total of two head chips 41 and 42) each having a nozzle group of a relatively small number of nozzles while staggering the head chips in the nozzle array direction.

As shown in FIG. 4, head chips each having a short printing width are arrayed with a positional relationship in which at least one nozzle (in FIG. 4, three nozzles) overlaps a corresponding nozzle at an end of each nozzle group laid out with a shift. Printing by overlapping nozzles is controlled as follows. Note that the number of overlapping nozzles is not limited to three as shown in FIG. 4.

Printing by scanning the full-line printhead relatively to a printing medium actually means conveying a printing medium while fixing the printhead.

A feature of the embodiment according to the present invention is printing control at the overlapping portion of the full-line printhead (to be referred to as the printhead hereinafter).

The embodiment assumes that the priority factor in the image quality changes depending on whether the drawing object is a text image or a graphic/halftone image. The embodiment executes printing control according to the type of drawing object. Edge sharpness is important for a text image or the like, while tonality is important for a graphic/halftone image.

The embodiment switches printing control in accordance with the type of drawing object at the boundary between head chips, i.e., the overlapping portion between nozzles where edge sharpness or smooth tonality is likely to be lost.

FIG. 4 shows how to switch the printing duty of each head chip at the overlapping portion between head chips. Each head chip prints print data at 100% duty at a non-overlapping portion. At the head chip overlapping portion, the head chip 41 is switched over to the head chip 42.

In FIG. 4, *a* is a view showing switching of the duty when printing a text image in which the edge sharpness of the line is considered as an importance factor. In this case, the printing duty of one head chip for print data switches from 0% to 100% without utilizing any intermediate value, and that of the other head chip switches from 100% to 0% without utilizing any intermediate value.

In FIGS. 4, *b* and *c* are views showing switching of the duty when printing a graphic image or halftone image, in which tonality is considered as an importance factor, without any printing density unevenness. In this case, the duty of one head chip switches from 0% to 100% smoothly via intermediate values, and that of the other head chip also switches from 100% to 0% smoothly via intermediate values. An example in b of FIG. 4 shows a linear duty change, whereas an example in c of FIG. 4 shows a curved duty change.

The duty may change in various patterns. Of these patterns, the most desirable pattern is a pattern in which the duty is smoothly changing over the entire width of the overlapping portion. This switching makes the unevenness change smoothest and least conspicuous.

This concept is also applicable to a serial printing apparatus which performs an operation to print while moving a carriage supporting a printhead and convey a printing medium by almost the printing width of the printhead every time scan printing ends. That is, the overlapping portion between scan printing passes is considered as the overlapping portion between the head chips of the full-line printhead. The pass is switched over under the same control as described before.

Figure 5:
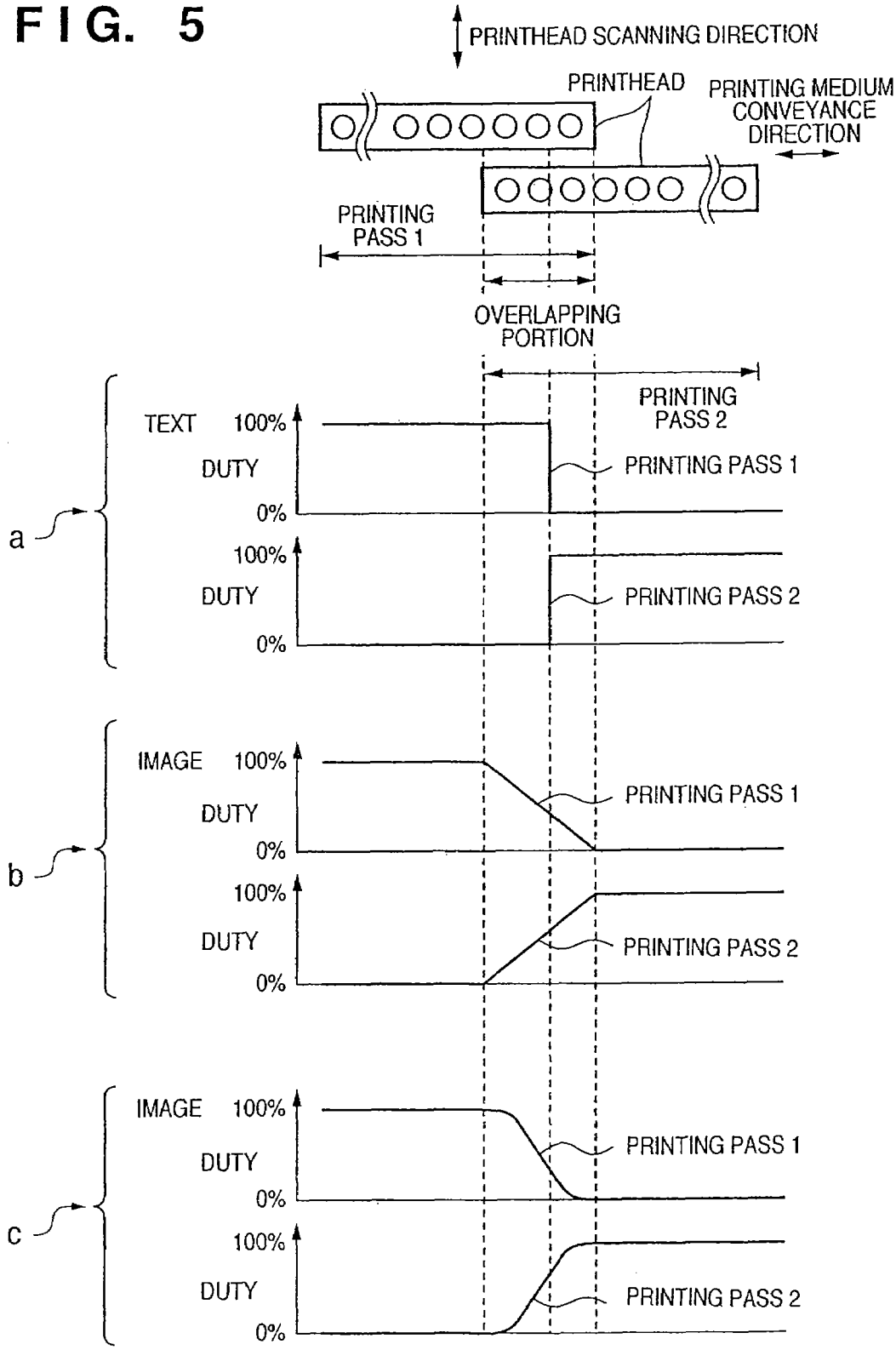
FIG. 5 is a view showing switching of the scan printing pass in a serial printing apparatus.

FIG. 5 is a view showing switching of the scan printing pass in a serial printing apparatus.

Also in this case, the duty of each scan printing pass is controlled at the overlapping portion between passes depending on whether the print image is a text image or a graphic/halftone image.

In FIG. 5, *a* shows switching of the duty when printing a text image, and *b* and *c* show switching of the duty when printing a graphic/halftone image.

The following printing control is performed when the serial printing apparatus which performs multi-pass printing of completing printing by n print scanning operations prints an image containing both a text image and graphic/halftone image. More specifically, in a case where the drawing object is a text image, the serial printing apparatus prints it by gaplessly connecting printing passes, as shown in a of FIG. 5. This printing increases the number of boundaries because of multi-pass printing for printing a text image, but improves edge sharpness. In a case where the drawing object is a graphic/halftone image, the serial printing apparatus prints the entire object by n scanning operations in multi-pass printing.

According to the present invention, when printing a text image, the same processing as "gapless connection" is performed. That is, a printing pass or head chip is switched over from one printing pass or head chip to the other printing pass or head chip at any position of the overlapping portion between the printing passes or head chips without any overlap between nozzles. In contrast, a bitmap image such as a graphic/halftone image is printed using the nozzles of two printing passes or two head chips at the entire overlapping portion.

This switching control is based on the concept that the sum of the duties of two head chips or two printing passes at each nozzle position in the nozzle array direction is equal to 100% of the duty of a portion printed by a single head chip or printing pass. However, it is possible to slightly increase/decrease and adjust the duty when a density printed at the sum of two duties becomes different from that of a portion printed by a single head chip or printing pass.

Head chip or printing pass switching positions basically coincide with each other in the nozzle array direction. In the nozzle array direction, one head chip or printing pass prints a text image up to a given nozzle position, and the other head chip or printing pass prints it from the next nozzle position.

A phenomenon in which ink discharge from a nozzle at an end of the head chip deviates to the center of the head chip (to be referred to as discharge deviation at an end of the printing array hereinafter) may occur in the nozzle array direction.

Figure 6:
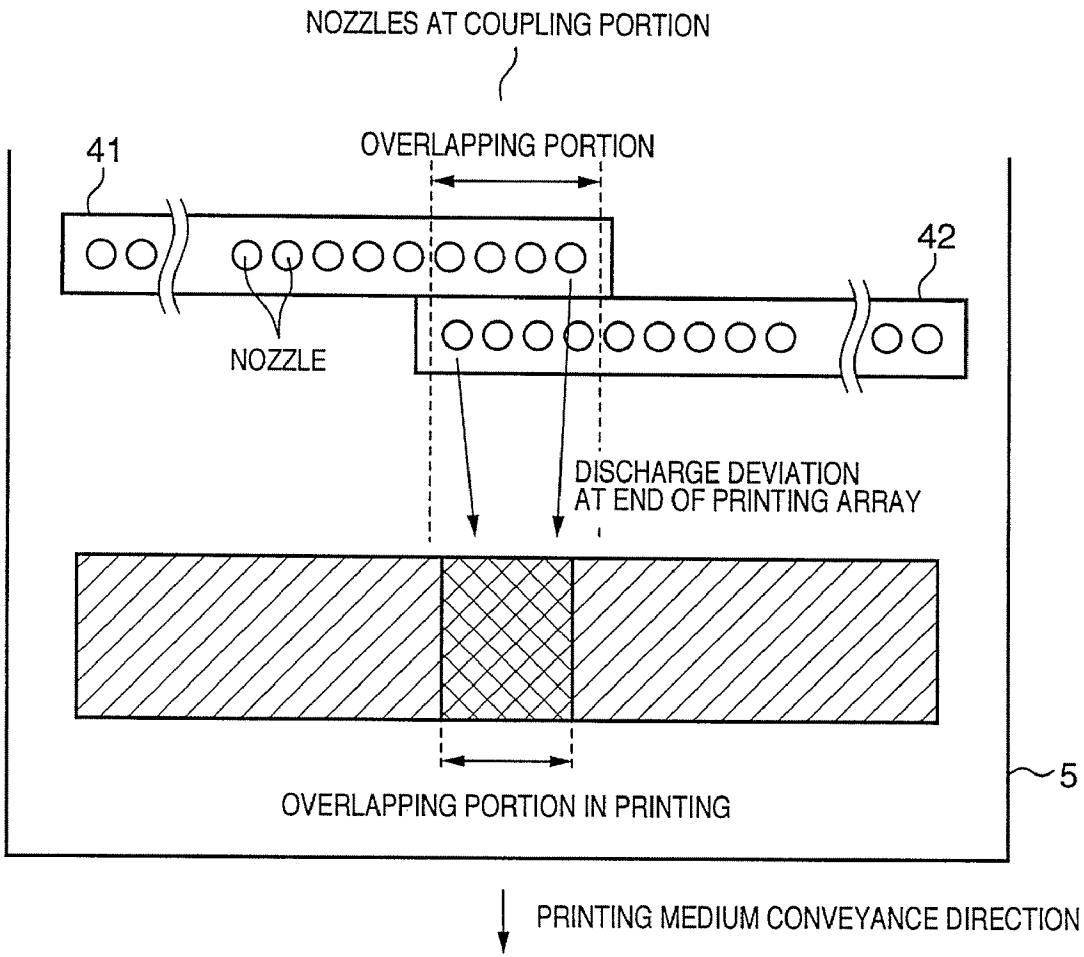
FIG. 6 is a view schematically showing discharge deviation at an end of the printing array.

FIG. 6 is a view schematically showing discharge deviation at an end of the printing array.

As shown in FIG. 6, the width of the overlapping portion on a printing medium sometimes becomes shorter than an actual overlapping nozzle width between head chips in the nozzle array direction. As a result, the positions of two corresponding nozzles which print at the same position on the printing medium in the nozzle array direction deviate from each other. In this case, it is desirable to determine the head chip or printing pass switching position so that the positions in the nozzle array direction coincide with each other on a printing medium in accordance with the deviation amount.

The determination criterion of whether the drawing image is a text image or a graphic/halftone image may be that the printing density of the object is "0" or the maximum value of a representable density value and does not include any intermediate density value. When the line width of a graphic image is small, the graphic image may be handled similarly to a text.

A host computer (to be referred to as a host hereinafter) which transmits print data to the printing apparatus may perform this determination processing. More specifically, when the application itself separately manages text data and bitmap data, it may output a data type identification flag upon transferring data to the printer driver via the OS of the host. In this case, the printer driver or the like preferably incorporates a function of performing connection image processing corresponding to text data and bitmap data by using the flag.

In order to maintain the edge sharpness of the line, it is important to maintain an accurate printing position even between printing passes or head chips. To maintain the precision of the printing position in the head chip, a plurality of nozzle arrays may be integrated in one head chip, unlike an arrangement in which one head chip has one nozzle array, as shown in FIG. 4 or 6. The positional relationship between nozzle arrays in a single head chip can be kept at high precision by manufacturing the head chip by a semiconductor manufacturing process. The precision is much higher than the attachment position precision between head chips or the printing medium conveyance precision associated with the precision between printing passes.

FIGS. 7A to 7D are views showing examples of an arrangement in which a plurality of nozzle arrays are integrated in one head chip.

Figure 7A:
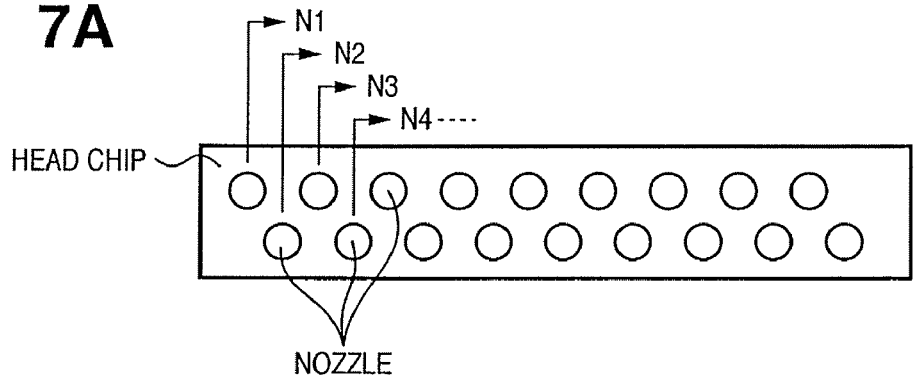
FIGS. 7A, 7B, 7C, and 7D are views showing examples of an arrangement in which a plurality of nozzle arrays are integrated in one head chip.

FIG. 7A shows an arrangement in which nozzles of nozzle numbers N1, N2, N3, N4, . . . are divided into two arrays: a nozzle array of odd-numbered nozzles and a nozzle array of even-numbered nozzles. This arrangement makes it possible to double the printing resolution in the nozzle array direction, compared to an arrangement in which one nozzle array is integrated in one head chip.

Figure 7B:
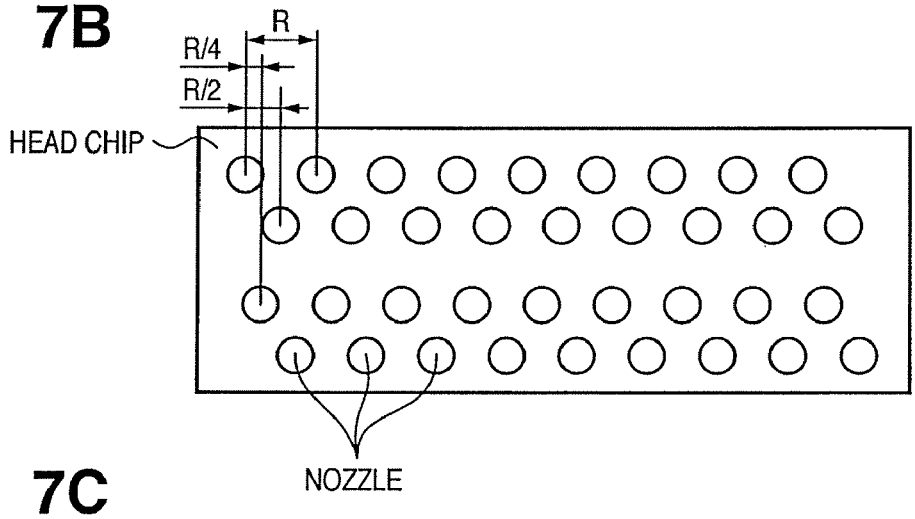
Figure 7C:
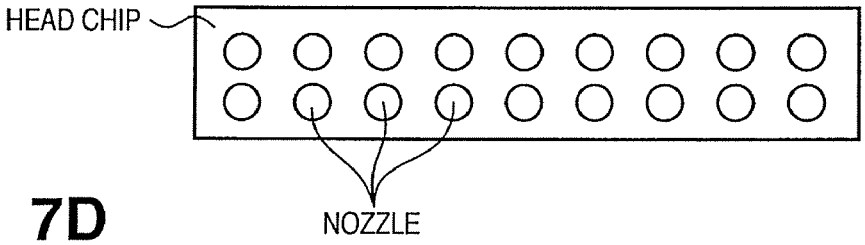
Figure 7D:
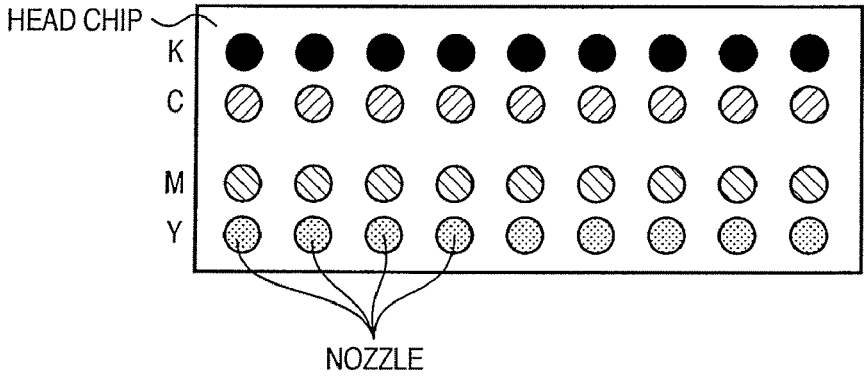

FIG. 7B shows an arrangement in which four nozzle arrays are integrated, the nozzle pitch is half of that in the arrangement shown in FIG. 7A, and the printing resolution in the nozzle array direction is four times higher than that in the arrangement in which one nozzle array is integrated in one head chip. FIG. 7C shows an arrangement of integrating two nozzle arrays printable at the same position in the nozzle array direction. FIG. 7D shows an arrangement in which a plurality of nozzle arrays discharge inks of different colors.

Such an arrangement of integrating a plurality of nozzle arrays in one head chip is applicable to both printing with ink of the same color from a plurality of nozzle arrays and printing with inks of different colors from a plurality of nozzle arrays. Even when one head chip prints, printing with a smaller number of nozzle arrays can more easily ensure the precision of the printing position.

The purpose of a printhead in which a plurality of nozzle arrays are integrated in a single head chip in correspondence with a plurality of ink colors is to suppress occurrence of density unevenness and a stripe when printing a graphic image or halftone image. This arrangement makes it possible to distribute printing such that ink discharged from a plurality of nozzle arrays forms printed dots, thereby suppressing occurrence of density unevenness and a stripe. When printing a text image, the edge sharpness of the line must be maintained, so printing using a smaller number of nozzle arrays is desirable even if a plurality of nozzles exist at the same printing position in the nozzle array direction. This printing increases the precision of the printing position.

A plurality of nozzle arrays may be integrated in a single head chip in correspondence with inks of a plurality of colors in consideration of the limitation on the nozzle driving frequency and the limitation by the printing density. In this case, it goes without saying that the number of nozzle arrays for use can be decreased only within a range of printing density required for the design of the printing apparatus.

However, the above-described printing duty control at the printing boundary is applicable to any case.

In addition, in a case where only one head chip or printing pass can print a drawing object at the overlapping portion between head chips or printing passes, a head chip or printing pass on the side on which the drawing object continues may print at the overlapping portion. This setting enables printing a high-quality image.

Figure 8:
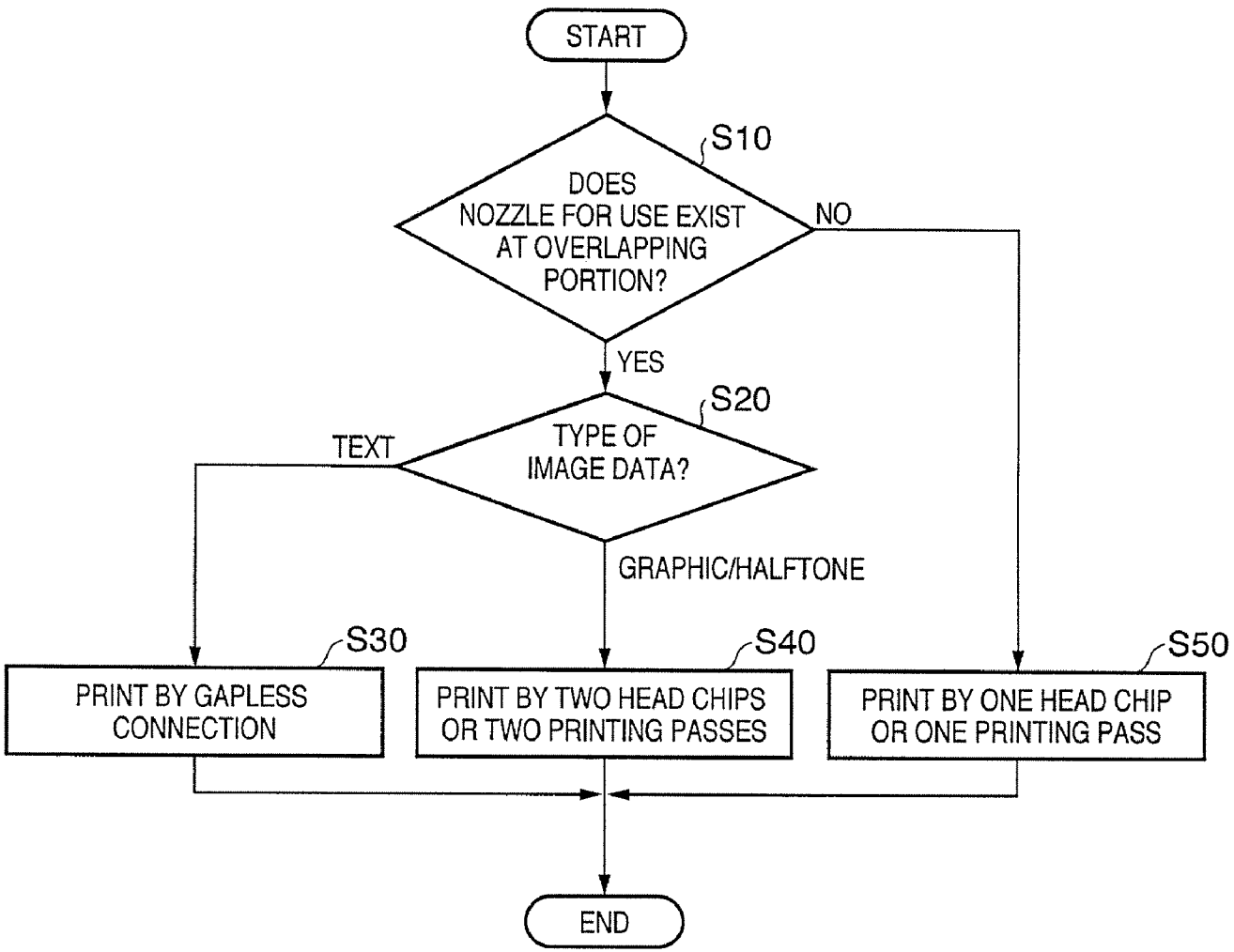
FIG. 8 is a flowchart showing printing control processing at an overlapping portion.

The flowchart in FIG. 8 shows the above-described processing.

FIG. 8 is a flowchart showing printing control processing at an overlapping portion.

In step S10, it is checked whether or not a nozzle used to print an object exists at an overlapping portion. If it is determined that the nozzle to print does not exist at the overlapping portion, the process advances to step S50 to print by one head chip or one printing pass, and then ends. If it is determined that the nozzle to print exists at the overlapping portion, the process advances to step S20.

In step S20, it is checked whether image data used for printing is a text image or a graphic/halftone image. If it is determined that the image data is a text image, the process advances to step S30. On the other hand, if it is determined that the image data is a graphic/halftone image, the process advances to step S40.

In step S30, printing is performed under the control to switch printing from one head chip (printing pass) to the other head chip (printing pass) at any position of the overlapping portion, like "gapless connection" as shown in a of FIG. 4 or a of FIG. 5. After that, the process ends.

In step S40, printing is performed under the control to switch printing from one head chip (printing pass) to the other head chip (printing pass) while changing the duty throughout the overlapping portion, as shown in b or c of FIG. 4, or b or c of FIG. 5. Then, the process ends.

As has been described above, according to the embodiment, printing at a portion where two head chips or printing passes overlap each other is so controlled as to change duty switching depending on whether to print a text image or a graphic/halftone image. Hence, appropriate printing is possible in accordance with the image type at the portion where two head chips or printing passes overlap each other.

By emphasizing edge sharpness, a text image can be printed at high quality at the portion where two head chips or printing passes overlap each other. Alternatively, a graphic/halftone image can be printed at high tonality and high quality without any density unevenness or stripe at the portion where two head chips or printing passes overlap each other.

The printing apparatus according to the present invention may be arranged integrally or separately as an image output terminal for an information processing device such as a computer. Also, the printing apparatus according to the present invention may take the form of a copying apparatus combined with a reader or the like, or the form of a facsimile apparatus having a transmission/reception function.

The above embodiment has described a printing apparatus which employs the inkjet method. However, the present invention is also applicable to a printing apparatus using a printhead complying with another printing method such as the wire dot method or thermal method. This is because the image quality degrades due to stripes or nonuniformity of an image caused by an error of the printing element array in the arrangement of the printing elements regardless of the printing method. Thus, the present invention is also effective to a printhead complying with another printing method such as the wire dot method or thermal method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-346972, filed Nov. 30, 2005, which is hereby incorporated by reference herein in its entirety.

What is claimed is:

1. A printing apparatus which uses printing means in which a plurality of printheads each having an array of printing elements are arranged along an array direction of the printing elements such that part of the arrayed printing elements in one of the plurality of printheads overlap part of the arrayed printing elements in another one of the plurality of printheads in the array direction, and which prints by moving the printing means relatively to a printing medium, wherein each of the plurality of printheads includes a plurality of head substrates, each of which is formed by arraying a plurality of printing elements, and printing elements at ends of respective head substrates overlap each other at a coupling portion between two adjacent head substrates, comprising:

first determination means for determining whether two adjacent head substrates in at least any one of the plurality of printheads are printable in the same area on the printing medium on the basis of input image data;

second determination means for determining whether the input image data is used to print a text image or a graphic/halftone image; and control means for controlling to print in the same printing area printable by the two adjacent head substrates in at least any one of the plurality of printheads by changing respective ratios at which printing elements of the two adjacent head substrates in at least any one of the plurality of printheads are used, in accordance with determination results by said first determination means and said second determination means, wherein in a case where said second determination means determines that the input image data is used to print a graphic/halftone image, said control means controls to print an image corresponding to the coupling portion by using the printing elements of both of the two adjacent head substrates, said control means further controls to change input image data distribution for the printing elements of the two adjacent head substrates such that a ratio at which printing for the coupling portion is performed using printing elements of one head substrate of the two adjacent head substrates gradually decreases towards an end of the one head substrate, and a ratio at which printing for the coupling portion is performed using printing elements of the other head substrate also gradually decreases towards an end of the other head substrate, and in a case where said second determination means determines that the input image data is used to print a text image, said control means controls to print at the coupling portion by driving a printing element of one of the two adjacent head substrates forming the coupling portion.

2. The apparatus according to claim 1, further comprising conveyance means for conveying the printing medium.

3. The apparatus according to claim 2, further comprising scanning means for scanning the printing means in a direction perpendicular to a conveyance direction of the printing medium by said conveyance means, wherein a printing area by scan printing of the printing means overlaps a printing area by next scan printing.

4. The apparatus according to claim 1, wherein said control means controls to switch a printing element used for printing from, out of printing elements overlapping at the coupling portion, a printing element of one head substrate of the two adjacent head substrates forming the coupling portion to a printing element of the other head substrate.

5. A printing method of a printing apparatus which uses printing means in which a plurality of printheads each having an away of printing elements are arranged along an array direction of the printing elements such that part of the arrayed printing elements in one of the plurality of printheads overlap part of the arrayed printing elements in another one of the plurality of printheads in the away direction, and which prints by moving the printing means relatively to a printing medium, wherein each of the plurality of printheads includes a plurality of head substrates, each of which is formed by arraying a plurality of printing elements, and printing elements at ends of respective head substrates overlap each other at a coupling portion between two adjacent head substrates, comprising:

a first determination step of determining whether or not two adjacent head substrates in at least any one of the plurality of printheads are printable in the same area on the printing medium on the basis of input image data;

a second determination step of determining whether the input image data is used to print a text image or a graphic/halftone image; and a control step of controlling to print in the same printing area printable by the two adjacent head substrates in at least any one of the plurality of printheads by changing respective ratios at which printing elements of the two adjacent head substrates in at least any one of the plurality of printheads are used, in accordance with determination results in said first determination step and said second determination step, wherein in a case where said second determination step determines that the input image data is used to print a graphic/halftone image, said control step controls to print an image corresponding to the coupling portion by using the printing elements of both of the two adjacent head substrates, said control step further controls to change input image data distribution for the printing elements of the two adjacent head substrates such that a ratio at which printing for the coupling portion is performed using printing elements of one head substrate of the two adjacent head substrates gradually decreases towards an end of the one head substrate, and a ratio at which printing for the coupling portion is performed using printing elements of the other head substrate also gradually decreases towards an end of the other head substrate, and in a case where said second determination step determines that the input image data is used to print a text image, said control step controls to print at the coupling portion by driving a printing element of one of the two adjacent head substrates forming the coupling portion.

* * * * *